US006819287B2

(12) United States Patent
Sullivan et al.

(10) Patent No.: US 6,819,287 B2
(45) Date of Patent: Nov. 16, 2004

(54) PLANAR INVERTED-F ANTENNA INCLUDING A MATCHING NETWORK HAVING TRANSMISSION LINE STUBS AND CAPACITOR/INDUCTOR TANK CIRCUITS

(75) Inventors: Jonathan Lee Sullivan, Lincoln, NE (US); Douglas Kenneth Rosener, Santa Cruz, CA (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 171 days.

(21) Appl. No.: 10/292,841

(22) Filed: Nov. 12, 2002

(65) Prior Publication Data

US 2003/0174092 A1 Sep. 18, 2003

Related U.S. Application Data

(60) Provisional application No. 60/364,516, filed on Mar. 15, 2001.

(51) Int. Cl.[7] ..... H01Q 1/38; H01Q 1/24

(52) U.S. Cl. ..... 343/700 MS; 343/702

(58) Field of Search ..... 343/700 MS, 702, 343/795, 850, 846, 848, 806, 852, 793, 860

(56) References Cited

U.S. PATENT DOCUMENTS 6,184,836 B1 * 2/2001 Ali ..... 343/702
6,239,765 B1 * 5/2001 Johnson et al. ..... 343/795
6,407,710 B2 * 6/2002 Keilen et al. ..... 343/702
6,567,047 B2 * 5/2003 Kuck ..... 343/700 MS
6,580,397 B2 * 6/2003 Lindell ..... 343/702
6,674,411 B2 * 1/2004 Boyle ..... 343/860

* cited by examiner

*Primary Examiner*—Hoang V. Nguyen
*Assistant Examiner*—Chuc Tran
(74) *Attorney, Agent, or Firm*—Holland & Hart LLP

(57) ABSTRACT

A small multi-band planar inverted-F antenna (PIFA) includes a metal radiating element that is physically located above a metal ground plane element, and the space therebetween includes a frequency matching network having a microstrip transmission line that connects an antenna feed to a wireless communications device (WCD) feed. The impedance matching network may include a microstrip impedance transformer whose output provides a 50 ohm connection to the WCD. A number of microstrip stubs are connected to the microstrip transmission line. At least some of the microstrip stubs connect to the microstrip transmission line by way of a LC tank circuit. The LC tanks circuits are responsive to different ones of the multiple frequencies to which the PIFA is responsive, and in this manner the impedance matching network is dynamically reconfigured in accordance with the frequency band currently traversing the microstrip transmission line. The LC tanks circuits include discrete capacitors and inductors. A two-shot molding process is used to make a unitary plastic antenna assembly whose second-shot plastic surfaces are metallized in order to provide the antenna's metal elements, including the microstrip circuit pattern of the impedance matching network.

37 Claims, 10 Drawing Sheets

PLANAR INVERTED-F ANTENNA INCLUDING A MATCHING NETWORK HAVING TRANSMISSION LINE STUBS AND CAPACITOR/INDUCTOR TANK CIRCUITS

This non-provisional patent application claims the priority of U.S. Provisional Patent application Ser. No. 60/364,516, filed on Mar. 15, 2001, entitled PLANAR INVERTED F ANTENNA INCLUDING A MATCHING NETWORK MADE UP OF TRANSMISSION LINE STUBS AND CAPACITOR/INDUCTOR TANK CIRCUITS, which provisional patent application is incorporated herein by reference.

FIELD OF THE INVENTION

This invention relates to the field of wireless communication, and more specifically to the field of radio wave antennas. This invention provides planar inverted-F antennas (PIFAs) for use in wireless communication devices (WCDs) such as cellular wireless devices and wireless personal communication devices, wherein the PIFAs include a matching network.

BACKGROUND OF THE INVENTION

It is known that a WCD may include a PIFA having a matching network.

For example, US published patent application U.S. Ser. No. 2001/0033250 A1 (incorporated herein by reference) describes an asymmetrical dipole antenna having a planar ground plane element, a three-fingered matching network, and a resonator element, the antenna being adapted to fit within the housing of a WCD. The resonator element is closely spaced and generally parallel to the matching network and the underlying ground plane element. Skirt portions of the resonator element are folded downward toward the matching network. A first conductor extends downward to connect the resonator element to the ground plane element. A second conductor extends downward to connect the resonator element to the matching network. A third conductor extends downward to connect the central-finger of the three-finger matching network to the ground plane element. The resonator element includes a serpentine conductor having two physically spaced open-ends, having a first conductor-portion that resonates within the cell phone band of 880–960 MHz, and having a second conductor-portion that resonates within the personal communications services (PCS) band of 1710–1880 MHz. An optional tuning capacitor is connected between one of the two open-ends and the ground plane element. A 50 ohm feed-point for the antenna is located at one of the two outside fingers of the three-finger matching network. The central finger of the matching network is in the nature of a matching stub, and the other outside finger of the three-finger matching network is in the nature of a series resonant matching element.

It is desirable that the antenna of a WCD simultaneously function across multiple frequency bands, and that these frequency bands be wide frequency bands. It is also desirable that the antenna be of a small physical size, so as to be unobtrusive, and so as to enable a pleasing industrial design to be provided for the WCD.

As used herein the term bandwidth can be defined as the width of a communications channel. In analog communications, bandwidth is typically measured in cycles per second (Hertz). In digital communications, bandwidth is typically measured in bits per second (bps). It is often desired that these bandwidths be wide bandwidths. That is that the range of frequencies over which power is transferred to, and received from, the WCD's antenna be wide.

PIFAs are well suited for use as WCD embedded antennas, and PIFAs can provide a good match at different frequencies simultaneously, without the need for a matching network, thus providing multi-band operation. However, when the frequency bands are close together, or wide, matching becomes more difficult.

It is also known that as the physical volume that is enclosed by a PIFA decreases, the PIFA's bandwidth of operation decreases. Thus, a typical PIFA will reach limits in bandwidth as the physical size of the PIFA is reduced. For example, a typical PBW of a small size dual-band PIFA (for example 880–960 MHz and 1710–1880 MHz) used in hand-held communications devices is about 10 percent, wherein PBW can be defined as 100 times the upper frequency of the bandwidth minus the lower frequency of the bandwidth divided by the square root of the upper frequency of the bandwidth times the lower frequency of the bandwidth.

Matching networks have been used to reduce power that is reflected from an antenna's input, thus allowing the antenna to operate over a wider bandwidth.

When a matching network includes discrete electrical components or discrete circuit elements to provide additional poles (singularities) to the matching network's transfer function, each positive frequency pole typically requires the addition of two discrete electrical components, thus increasing the cost and reducing the reliability of the antenna.

Distributed matching networks that are made up of microstrip transmission lines inherently provide multiple poles and zeros within the transfer function of the matching network. However, because distributed matching networks are often on the order of a wavelength in physical size, such matching networks can require a large physical area, especially when such matching networks are used to match multiple bandwidths.

A common technique to provide wideband matching is to use shorted and open transmission line stubs in parallel (for example, see MICROWAVE CIRCUIT DESIGN, John Wiley and Sons, 1990, at pages 180–181).

Transmission line stubs are distributed circuits, and by adjusting the physical parameters of the stubs it is often possible to place zeros to cancel undesirable poles and to add other poles at more beneficial frequencies. However, the problem of using this technique in multi-band antenna designs is that while one frequency band widens due to a match that is achieved by the use of transmission line stubs, another frequency band is corrupted due to the addition of the transmission line stubs.

SUMMARY OF THE INVENTION

This invention provides a dual-band PIFA having a unique matching network that is incorporated into a unique physical position within the PIFA using a one or more unique manufacturing process steps. The matching network selectively tunes the PIFA to at least two desired frequency bands, and the matching network intrinsically provides a good match in the frequency bands that are of interest.

When the frequency bands of interest do not have a desired bandwidth, a microstrip stub technique is used to widen the bandwidth for these frequency bands.

In accordance with the invention, and using one or more discrete-component LC tank circuits, one or more microstrip stubs are high-impedance-disconnected from the matching network at one or more frequency bands wherein it is not desired have these microstrip stubs operate. As a result, the invention eliminates the need to provide additional microstrip stubs or other components in order to achieve matching over multiple frequency bands that have wide bandwidths.

An embodiment of this invention provides a dual-band PIFA having a small-size matching network that is integrated into the PIFA, wherein the PIFA includes a metallic radiating/receiving element (hereinafter radiating element) and a metallic ground plane element. As a result of this new and unusual construction and arrangement a PIFA and its matching network is provided within a physical volume that is no larger than the physical volume that is required for the basic components of a PIFA.

In accordance with a feature of the invention, the matching network includes at least one discrete capacitor (C) component, at least one discrete inductor (L) component, and distributed microstrip transmission line stubs that cooperate to broadband/wideband match to the antenna's radiating element within at least two frequency bands.

In addition, the antenna and its integral matching network are manufactured as a single physical part, to thus form a single unitary assembly for mounting on a main printed circuit board (PCB) of a WCD. One utility of the invention is for use within small mobile telephones that can be carried in a shirt pocket.

In a non-limiting embodiment of the invention the distributed transmission-line portion of the matching network included an antenna-feed transmission line stub that was connected to the antenna's radiating element, a radio-feed transmission line stub that was connected to the input of a WCD, a shorted transmission line stub, and an open transmission line stub.

In this embodiment of the invention the open transmission line stub was effectively disconnected from the matching network at the lower frequency band by connecting a parallel LC frequency trap (i.e. a discrete-component LC tank circuit) in series with the open transmission line stub. This LC trap was formed by the parallel connection of a discrete capacitor and a discrete inductor, and the LC trap was tuned to resonate at a frequency that was at, or near to, the center frequency of the low frequency band.

While optimized performance of this embodiment of the matching network can place the resonant frequency of the LC trap away from the center frequency of the low frequency band, this resonant frequency is usually closer to the low frequency band than it is to the high frequency band.

This LC trap became a high impedance at the low resonant frequency of the LC trap, and this high impedance effectively disconnected the open transmission line stud from the matching circuit for frequencies in the low frequency band, thus mitigating the effects of the open transmission line stub on a match to the low frequency band, which match was optimized in this embodiment by the shorted transmission line stub and by the physical structure of the antenna's radiating element.

While the above-described embodiment of the invention provided that an LC trap was connected in series with only the open transmission line stub, within the sprit and scope of the invention an LC trap can be connected in series with only the shorted transmission line stub, or an LC trap can be connected in series with both of the open transmission line stub and the shorted transmission line stub.

That is, within the scope of this invention a matching network is provided having open and shorted transmission line stubs and LC traps, to thereby form a matching network that matches an antenna's radiating element to the input of a radio device such as a transmit/receive WCD within at least two frequency bands.

Because matching networks in accordance with the invention include one or more discrete-component LC tank circuits that operate to selectively disconnect one or more transmission line stubs at one or more desired frequency bands, the use of long transmission lines, and the use of a large number of discrete circuit components, is avoided.

In the above-described embodiment of the invention the high frequency band was from about 1710 MHz to about 2170 MHz, this corresponding to a PBW of about 24 percent.

A small physical volume for the PIFA is achieved in accordance with the invention both by a unique configuration of the matching network and by integrating the matching network directly under the antenna's radiating element. By integrating the matching network directly under the antenna's radiating element the size-footprint of the PIFA no larger than the size-footprint of the PIFA itself, this usually being the size of the antenna's ground plane element.

In addition, low cost is achieved in accordance with the invention by forming the matching network and other portions of the PIFA using one of two manufacturing process, i.e. by using (1) a stamped/bent metal process wherein the discrete LC components and an antenna feed are soldered onto a stamped/bent metal part, and wherein the resulting assembly is then surface-mounted onto an input/output WCD feed that is carried by the ground plane element and the main PCB of the WCD, or by using (2) a two-shot molding process wherein the discrete components are soldered onto a selectively-metallized two-shot molded assembly, and wherein the resulting assembly is then surface-mounted onto an input/output WCD feed that is carried by the ground plane element and the main PCB of the WCD, wherein the later process is a preferred process.

In an embodiment of the matching network's transmission line portion, the matching network's transmission line stubs, and the antenna's radiating element were made of a common electrically conductive material.

In addition, the dielectric substrate that carries the matching network's transmission line portion, the matching network's transmission line stubs, and the antenna's radiating element can comprise a common dielectric member.

In summary, and in accordance with the present invention, a multi-band antenna is impedance-matched to a multi-band wireless communications device by providing a microstrip transmission line that connects the antenna to the wireless communications device. A plurality of microstrip stubs are connected to the microstrip transmission line, and one or more LC tank circuits are associated with the microstrip stubs to selectively disconnect certain of the microstrip stubs from the microstrip transmission line in a manner to provide impedance matching within each of the multiple bands.

DETAILED DESCRIPTION

Figure 1:
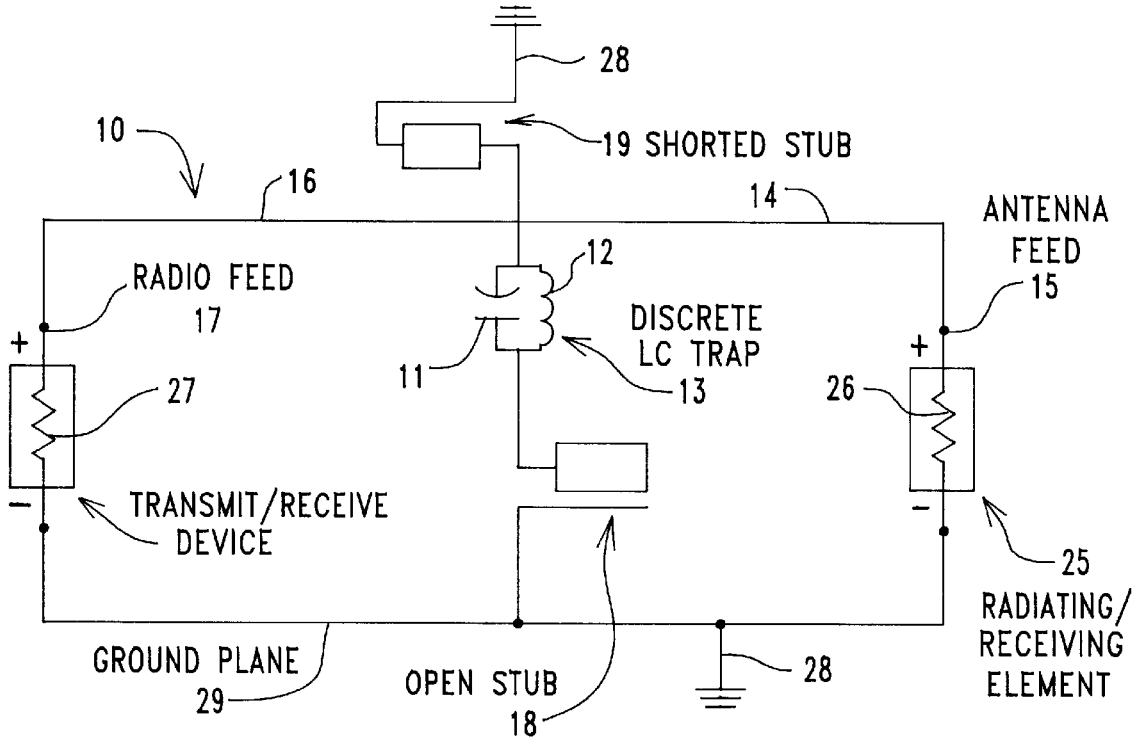
FIG. 1 is a schematic showing of a matching network in accordance with the invention wherein the matching network includes a distributed microstrip transmission line that interconnects an antenna feed and a radio feed, a closed transmission line stub that is directly connected to the distributed microstrip transmission line, and an open transmission line stub that is connected to the distributed microstrip transmission line through an LC trap that is made up of a discrete inductor connected in parallel with a discrete capacitor.

FIG. 1 is a schematic showing of a dual frequency band matching network 10 in accordance with the invention.

In this non-limiting embodiment of the invention matching network 10 included (1) a discrete capacitor 11 and a discrete inductor 12 that form a discrete-component LC tank or trap circuit 13, (2) a distributed microstrip line 14 to which an antenna feed 15 was connected, (3) a distributed microstrip line 16 to which a radio feed 17 to the transmit/receive input of a WCD (not shown) was connected, (4) an open transmission line stub 18, and (5) a shorted transmission line stub 19.

Figure 2:
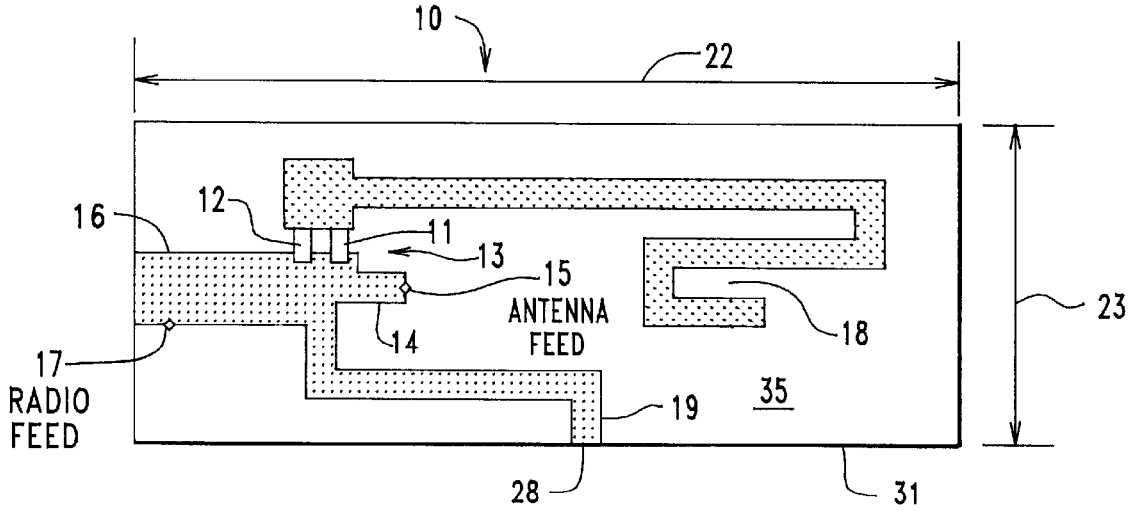
FIG. 2 is a top view of a printed circuit board that contains a metal pattern that defines the matching network shown in FIG. 1 and includes the discrete L and C components shown in FIG. 1.
Figure 3:
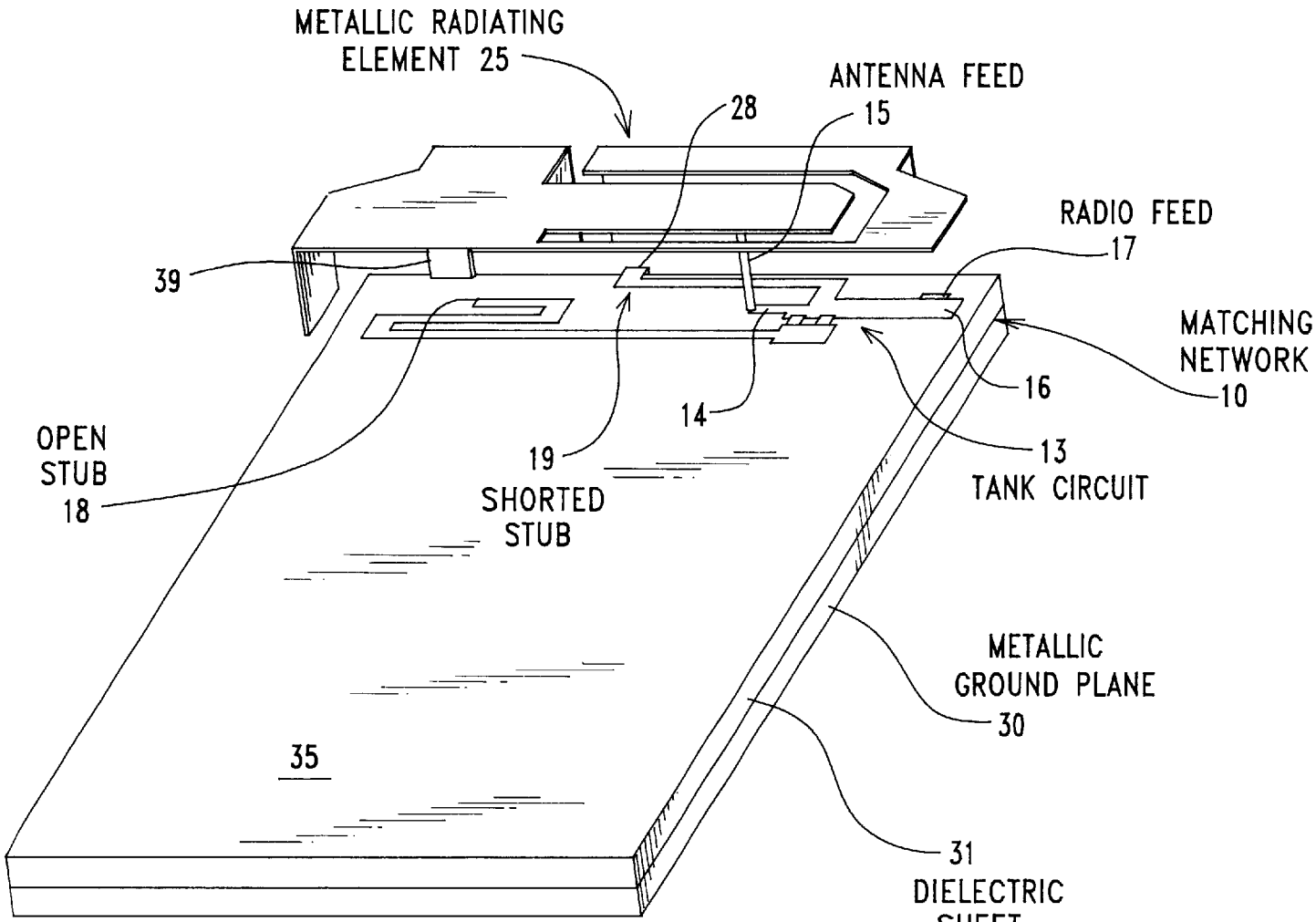
FIG. 3 is a top perspective view of a PIFA in accordance with the invention, this figure showing that the PIFA's metal radiating element is spaced from the PIFA's metal ground plane element, and this figure showing a matching network that is contained within the physical space that is between the radiating element and the ground plane element.

In an embodiment of the invention the above-described microstrip lines and transmission line stubs comprising metal patterns that were carried on the top surface 35 of a planar dielectric sheet 31, as is shown in FIGS. 2 and 3.

As best shown in FIG. 3, antenna feed 15 comprises an upward-extending metal strap that electrically connects antenna feed 15 to the antenna's metallic radiating element 25. In FIG. 1 radiating element 25 is represented by a resistor 26, whereas radio feed input 17 is represented by a resistor 27.

In a non-limiting embodiment of the invention, the antenna's metal radiating element 25 was constructed an arranged to provide a first metal portion that resonated within the 880–960 MHz frequency band, and to provide a second metal portion that resonated within the 1710–2170 MHz frequency band.

In FIG. 1 the antenna's metallic ground plane element is shown using conventional ground symbols 28, whereas in FIG. 3 the antenna's ground plane element is shown as it actually exists, i.e. as a planar sheet of metal 30 that covers the bottom surface of a rigid sheet 31 of dielectric material.

Also as best shown in FIG. 3, the metal end 20 of shorted transmission line stub 19 extends downward and over the upper edge of dielectric sheet 31, whereat the metal end 20 of shorted transmission line stub 19 is electrically connected to metal ground plane element 30.

While it is not a limitation on the invention, in one utility of the invention the major area 35 of the top dielectric surface of dielectric material 31 supported the components of a WCD such as a cellular telephone, whereas the bottom surface of dielectric material 31 supported the PIFA's ground plane element 30.

As stated above, a discrete-component tank circuit of the type shown at 13 in FIGS. 1, 2 and 3 can be connected in series with one or more open transmission line stubs, or such a tank circuit 13 can be connected in series with one or more shorted transmission line stubs, or such a tank circuit 13 can be connected in series with one or more of open transmission line stubs and/or one or more shorted transmission line stubs.

That is, the embodiment of the invention that is shown in the various figures of this application provides for the matching of the PIFA's radiating element 25 to FIG. 1's transmit/receive device 27 within the two frequency bands 880–960 MHz and 1710–2170 MHz, and in this utility matching network 10 of FIGS. 1, 2 and 3 provides an LC trap 13 that is connected in series with only open transmission line stub 18 and that operates to effectively disconnect open transmission line stub 18 from matching network 10 at the lower frequency band of 880–960 MHz.

However, within the scope of this invention, and perhaps for two or more different frequency bands, a discrete-component LC trap can be provided in series with one or more shorted transmission line stubs, to thereby effectively disconnect that shorted transmission line stub(s) from the matching network at one or more of the two or more frequency bands.

It is also within the scope of this invention that two discrete-component LC traps can be provided within a matching network. In this configuration, one LC trap may be connected in series with an open transmission line stub, and the other LC trap may be connected in series with a shorted transmission line stub. In this case, one of the two LC traps becomes a disconnecting-impedance at one of the two frequency bands, as the other of the two LC traps becomes a disconnecting-impedance at the other of the two frequency bands.

By way of a non-limiting example of the invention, in an embodiment of the invention dimension 22 of matching network 10 shown in FIG. 2 was about 1500 mils and dimension 23 was about 600 mils.

Figure 4:
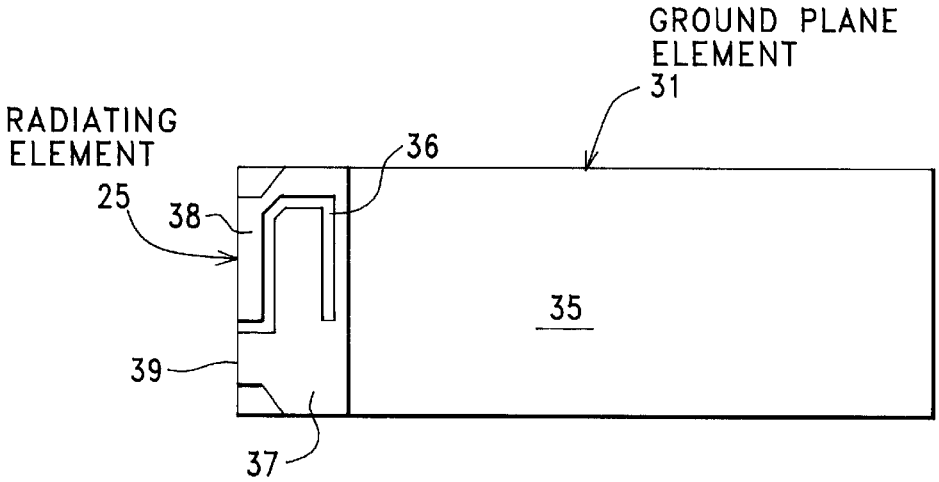
FIG. 4 is a top planar view of the PIFA of FIG. 3, this figure showing a slot that divides the PIFA's radiating element into two resonator portions.

FIG. 4 is a top view of the PIFA that is shown in FIG. 3, this figure better showing the structural nature of the antenna's metal radiating element 25.

Radiating element 25 occupies a plane that is spaced above, and generally parallel to, the planar surface 35 of dielectric sheet 31 whose bottom surface carries metal ground plane element 30. A serpentine-shaped slot or cut 36 is formed in radiating element 25, and slot 36 operates to divide the planar surface of radiating element 25 into a first relative large metal area 37 that resonates at the low frequency to which the PIFA is responsive (for example 880–960 MHz), and a second relatively small metal area 38 that resonates at the high frequency to which the PIFA is responsive (for example 1710–1880 MHz).

The downward-extending edge-portion 39 of radiating element 25 (best seen in FIG. 3) operates to electrically connect radiating element 25 to ground plane 30 element. When radiating element 25 is formed of a relatively rigid piece of metal, radiating element 25 can be self-supported above dielectric surface 35 by way of the wide strap-like nature of this downward-extending edge-portion 39.

Figure 5:
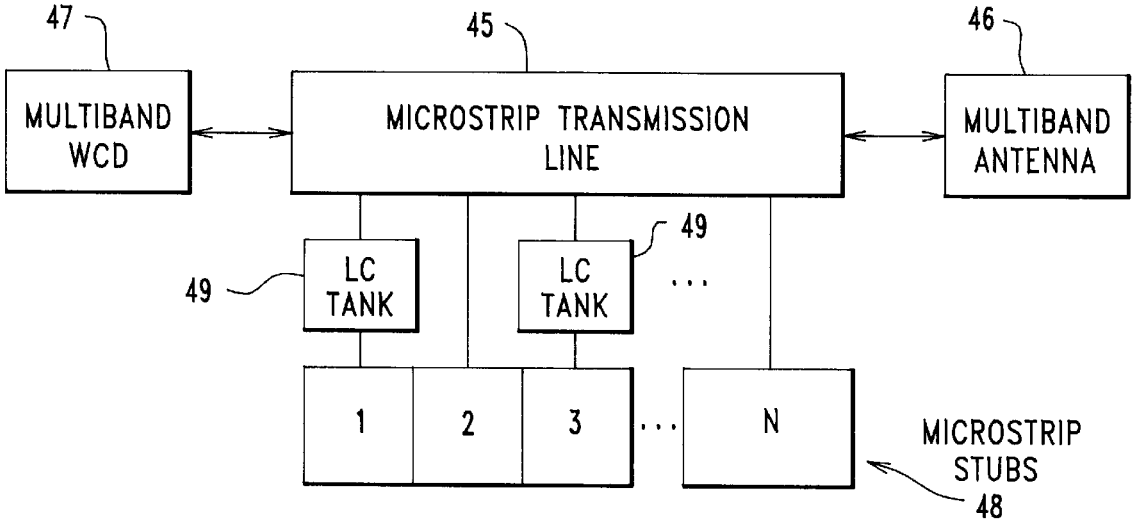
FIG. 5 is a general showing of a matching network in accordance with the present invention having the number N of microstrip stubs wherein an LC tank circuit is connected in series with some of the microstrip stubs.

FIG. 5 shows a more general embodiment of a matching network in accordance with the invention. In FIG. 5 a metal microstrip transmission line 45 electrically connects a multi-band antenna 46 to a radio-device such as multi-band WCD 47.

In order to provide for the multi-band frequency matching of antenna 46 to WCD 47, and in order to also provide for a wide bandwidth within each of the plurality of frequency bands, a series of metal microstrip stubs 48 are selectively connected to microstrip transmission line 45 as a function of the frequency band that is currently passing through microstrip transmission line 45.

In this example, the integer number N of microstrip stubs 48 are provided. This series of microstrip stubs 48 can be any combination of shorted stubs and/or open stubs, as may be required.

In accordance with the invention, one or more LC traps 49 are connected in series with one or more of the microstrip stubs 48.

Each of the various LC traps 49 are selectively effective within a desired one of the plurality of frequency bands in which antenna 46 and WCD 47 operate, to thereby selectively high-impedance-disconnect certain microstrip stubs 48 from microstrip transmission line 45 as is necessary to achieve impedance matching and high bandwidth within each of the plurality of frequency bands.

Figure 6:
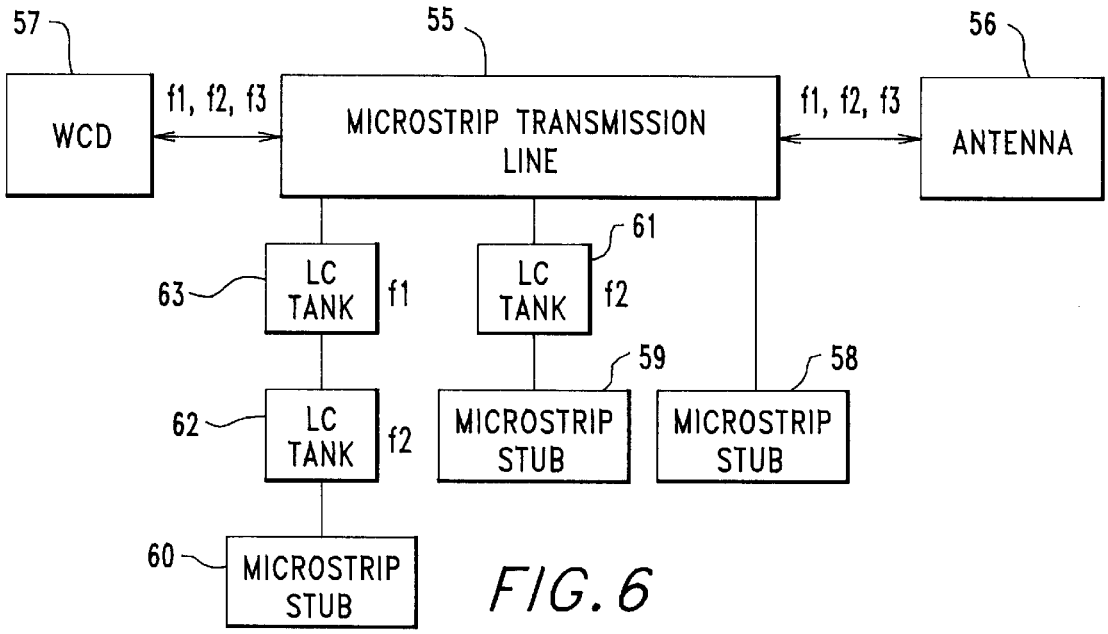
FIG. 6 is another general showing of a matching network in accordance with the present invention having three microstrip stubs wherein two LC tanks circuits are connected in series with one of the microstrip stubs and a single LC tank circuit is connected in series with another of the microstrip stubs.

FIG. 6 provides another general showing of a matching network in accordance with the present invention. In FIG. 6 a microstrip transmission line 55 impedance-matches an antenna 56 to a WCD 57 within three frequency bands that are individually identified as $f_1$, $f_2$ and $f_3$.

In the FIG. 6 non-limiting example wherein three microstrip stubs 58, 59 and 60 are provided, at least two of the three microstrip stubs are connected to microstrip transmission line 55 in accordance with the frequency band that is currently passing through microstrip transmission line 55.

That is, when frequency band $f_1$ is present only microstrip stubs 58 and 59 are connected to microstrip transmission line 55, when frequency band $f_2$ is present only microstrip stub 58 is connected to microstrip transmission line 55, and when frequency band $f_3$ is present all three of the microstrip stubs 58–60 are connected to microstrip transmission line 55.

In FIG. 6, microstrip stub 58 is directly connected to microstrip transmission line 55, i.e. microstrip stub 58 is connected to microstrip transmission line 55 independent of the frequency band that is currently present in microstrip transmission line 55.

However, an LC tank circuit 61 that is responsive to frequency band $f_2$ series-disconnects microstrip stub 59 to microstrip transmission line 55. As a result, microstrip stub 59 is connected to microstrip transmission line 55 only when frequency band $f_1$ or frequency band $f_3$ is present.

In addition, an LC tank circuit 62 that is responsive to frequency band $f_2$ and an LC tank circuit 63 that is responsive to frequency band $f_1$ jointly series-disconnect microstrip stub 60 to microstrip transmission line 55. As a result, microstrip stub 60 is connected to microstrip transmission line 55 only when frequency band $f_3$ is present.

Figure 7:
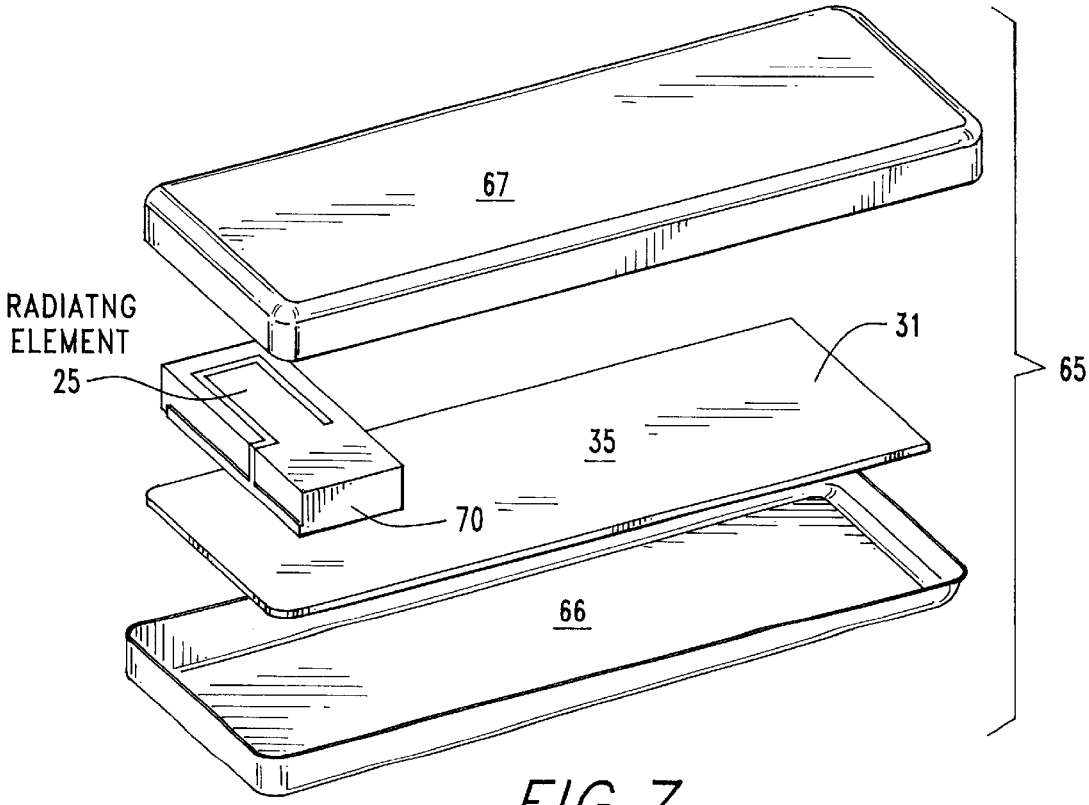
FIG. 7 is an exploded view of a WCD device such as a cellular telephone that includes the PIFA assembly of FIG. 3.

A valuable utility of the PIFA of the present invention is for use within a cellular telephone. FIG. 7 shows the above-described PIFA within the exploded view of a cellular telephone 65.

In FIG. 7 the cellular telephone's front face plate is shown at 66, and the cellular telephone's back plate is shown at 67. While the box-like assembly 70 that includes PIFA's radiating element 25 is mounted on the top surface 35 of dielectric sheet 31, in FIG. 7 assembly 70 and its radiating element 25 are shown exploded away from top surface 35, and matching network 10 is located on the bottom surface of assembly 70, under radiating element 25, so as not to be visible in FIG. 7.

In this construction and arrangement the major components (not shown) of cellular telephone 65 are carried on, or adjacent to, top surface 35 of dielectric sheet 31.

Figure 8:
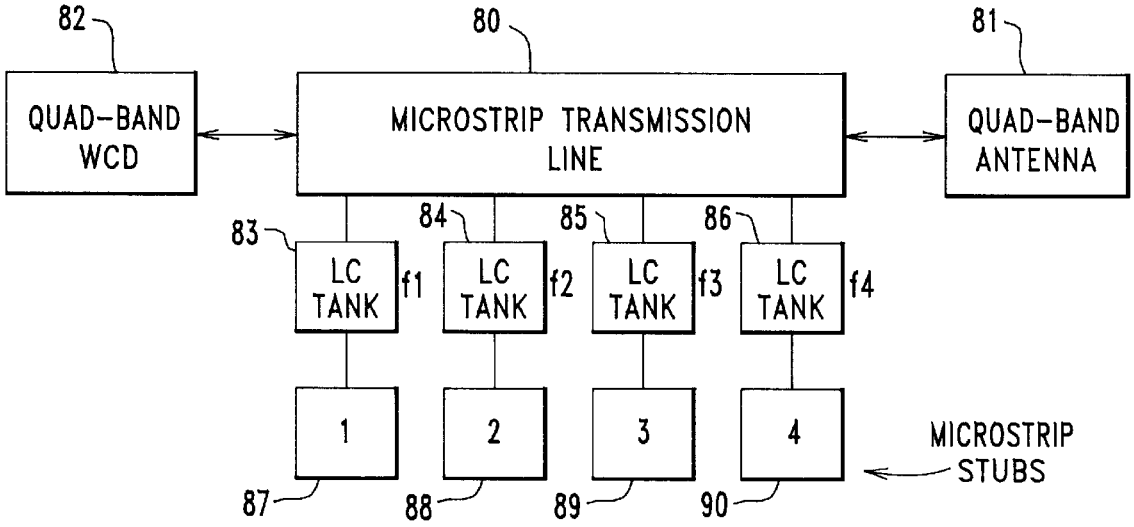
FIG. 8 is another general showing of a matching network in accordance with the present invention having four microstrip stubs wherein an LC tank circuit is connected in series with each of the microstrip stubs.

FIG. 8 provides another more general showing of a matching network in accordance with the present invention wherein a microstrip transmission line 80 connects a multi-band antenna 81 to a multi-band WCD 82. In this non-limiting embodiment of the invention, antenna 81 is a four-band (i.e. $f_1$–$f_4$) antenna and WCD 82 is a four-band WCD, and four microstrip stubs 87–90 are individually series-connected to microstrip transmission line 80 by way of one of four LC tanks circuits 83–86.

LC tank circuit 83 becomes a high impedance at a frequency $f_1$, LC tank circuit 84 becomes a high impedance at a frequency $f_2$, LC tank circuit 85 becomes a high impedance at a frequency $f_3$, and LC tank circuit 86 becomes a high impedance at a frequency $f_4$.

When communication through microstrip transmission line 80 occurs at a frequency band that includes frequency $f_1$, only microstrip stubs 88, 89 and 90 are connected to microstrip transmission line 80, to thereby impedance-match within this frequency band.

When communication through microstrip transmission line 80 occurs at a frequency band that includes frequency $f_2$, only microstrip stubs 87, 89 and 90 are connected to microstrip transmission line 80, to thereby impedance-match within this frequency band.

When communication through microstrip transmission line 80 occurs at a frequency band that includes frequency $f_3$, only microstrip stubs 87, 88 and 90 are connected to microstrip transmission line 80, to thereby impedance-match within this frequency band.

When communication through microstrip transmission line 80 occurs at a frequency band that includes frequency $f_4$ only microstrip stubs 87, 88 and 89 are connected to microstrip transmission line 80, to thereby impedance-match within this frequency band.

While FIGS. 5, 6 and 8 provide example of matching networks within the spirit and scope of the invention, these examples are not to be taken as a limitation on the number of configurations of a microstrip transmission line and a plurality of microstrip stubs that are within the spirit and scope of this invention.

For example, any number of microstrip transmission lines, any number of microstrip stubs and any number of frequency-responsive LC tank circuits can be provided in a matching-network-combination that responds to a frequency currently traversing between a multi-band antenna and a multi-band radio device, so as to dynamically configure the matching-network-combination to provide a proper impedance match between the multi-band antenna and the multi-band radio device as a function of this current-frequency.

As a feature of this invention, the above described assembly that includes the PIFA's radiating element may be a unitary, two-shot molded, plastic member that is selective metallized on the exposed outer surfaces of the second-shot plastic material in order to provide conductive metal patterns on the outer surfaces of the unitary plastic member. In this manner mechanical functions, electrical antenna functions, and electrical impedance matching functions are integrated within one unitary plastic member.

Figure 9:
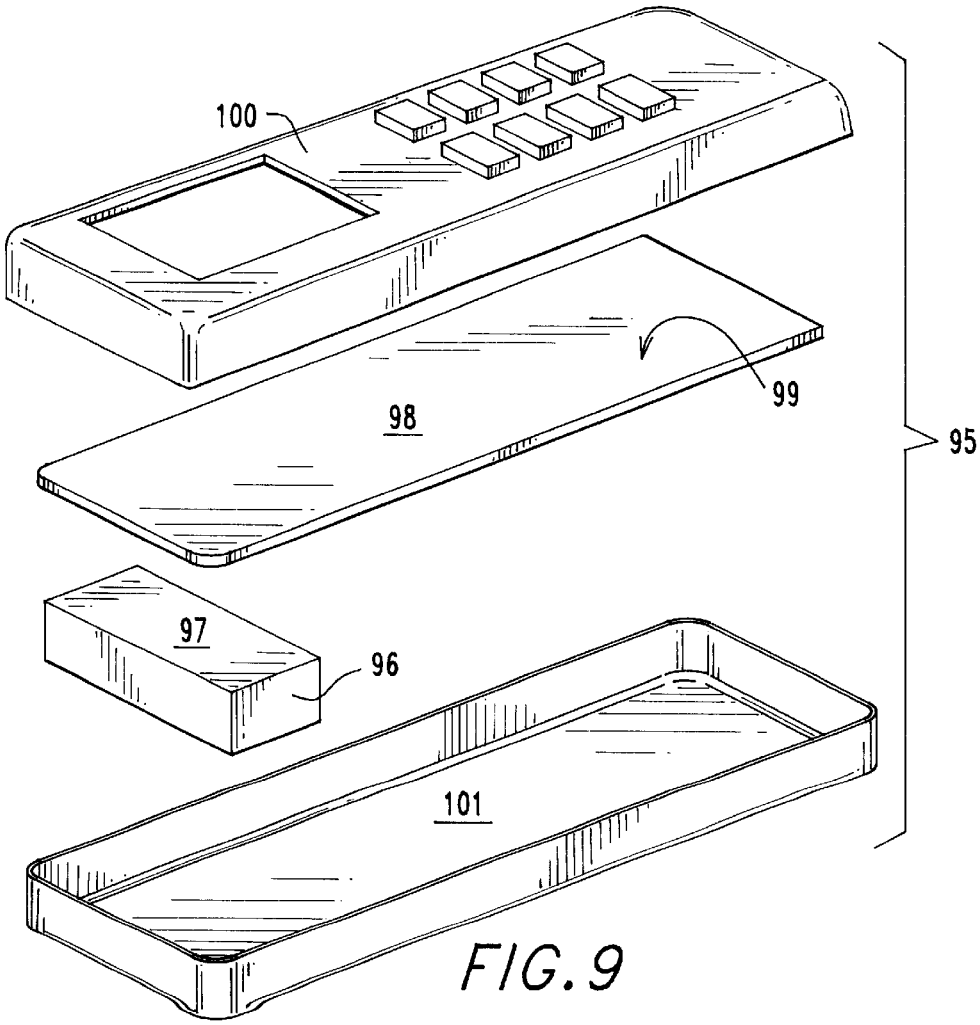
FIG. 9 is a showing similar to FIG. 7 wherein the PIFA includes a two-shot molded member whose outer surfaces have been metallized to provide the PIFA's metal radiating element and the metal portions of the PIFA's matching network, and where discrete L and C components are soldered onto a metallized portion of the two-shot molded member.

With reference to FIG. 9, an exploded view of a cellular telephone 95 is shown having a two-shot, injection molded, box-like, plastic member 96 wherein the top-surface 97 of plastic member 96 includes an impedance matching network as above-described, and wherein the bottom surface of member 96 includes a radiating element 25 as above-described, but not seen in FIG. 9.

Also shown in FIG. 9, the telephone's printed circuit board 98 includes telephone components on its bottom dielectric surface (not seen in FIG. 9), and includes a metal layer 99 on its top surface 98. Metal layer 99 functions both as a telephone circuit component and as a ground plane element for the telephone's PIFA, as is above described.

Also included in FIG. 9 is the telephone's top housing half 100 and the telephone's bottom housing half 101.

Figure 10:
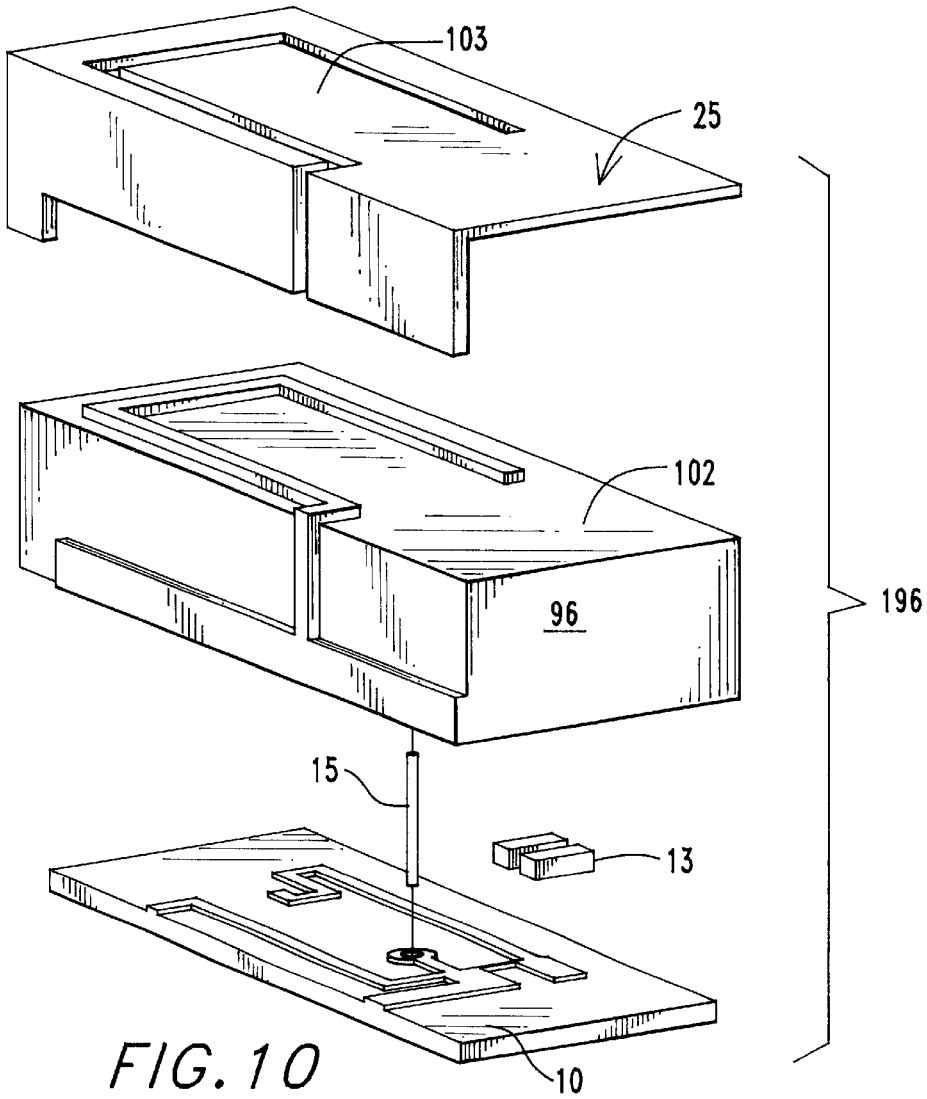
FIG. 10 is an exploded view that shows one manner of making the two-shot molded member of FIG. 9 wherein the matching network is formed as a separate board-like member that cooperates with the bottom surface of the two-shot member

With reference to FIG. 10, in a two-shot-molding manufacturing process of plastic member 96, a plastic core 102 of member 96 is first formed of a first-shot plastic material that does not have an affinity for metal plating. An example of such a first-shot plastic material is a crystalline material such as polycarbonate.

After plastic core 102 has been formed, a second-shot plastic material forms a pattern 103 of plastic material that has an affinity for metal plating. An example of such a second-shot material 103 is ABS (acrylonitrile butadiene styrene) or an ABS polycarbonate.

Once the unitary molded assembly 102,103 has been formed, this unitary assembly is subjected to an acid bath that operates to better enable the exposed surface of second-shot material 103 to accept a layer of plated metal. Thereafter, the unitary molded assembly 102,103 is plated. For example, it is electroless plated with a thin layer of palladium, followed by a thin layer of nickel, followed by a thin layer of copper.

In this way, the outer surface of plastic member 96 is selectively metallized. More generally, after the second molding shot has occurred, second-shot plastic 103 is sensitized to accept metal, and a plating process thereafter forms metal on these sensitized areas of plastic member 96.

In an embodiment of the invention a plastic member 96 formed by a two-shot molding process was first dipped into an acid etching bath to dissolve a portion of the amorphous second-shot plastic material 103, for example to dissolve a portion of the butadiene within the ABS second-shot plastic 103, and thereby roughen or form pockets in, the exposed surface of the ABS second-shot material 103. First-shot plastic material 102 is resistant to this acid etch step, for example because it is a crystalline plastic material.

The acid-etched and exposed surface of the second-shot plastic 103 can now be seeded for plating, for example by electroless plating a noble metal such as palladium or platinum thereon. A layer of a conductive metal such as nickel or copper is then electroless-plated onto the seeding layer.

In an embodiment of the invention, a palladium solution was used, followed by coating with a flash layer of nickel, followed by the electroless deposition of a conductive metal such as copper, followed by the electroless deposition of a corrosion-resistant metal such as nickel.

An alternative to the use of the above-described acid bath to sensitize the exposed surface of second-shot material 103 is doping the second-shot plastic material 103 with a metal catalyst.

In this way, a unitary plastic assembly 96 is provided that includes the above-described metal radiating element 25.

Impedance matching network 10 and its discrete L and C components 13 are shown in FIG. 10 as being separate structural members, and an antenna feed pin 15 is shown for connecting radiating element 25 to impedance matching network 10.

However, the above-described two-shot molding process can also be used to form the metal patterns of impedance matching network 10 on a second-shot plastic material 103 that is provided on the bottom surface of plastic member 96, followed by metallization as described above. In this case, a discrete capacitor and inductor for each LC tank that is within the impedance matching network are soldered onto the bottom of, or perhaps onto a side of, unitary plastic assembly 196.

Figure 11A:
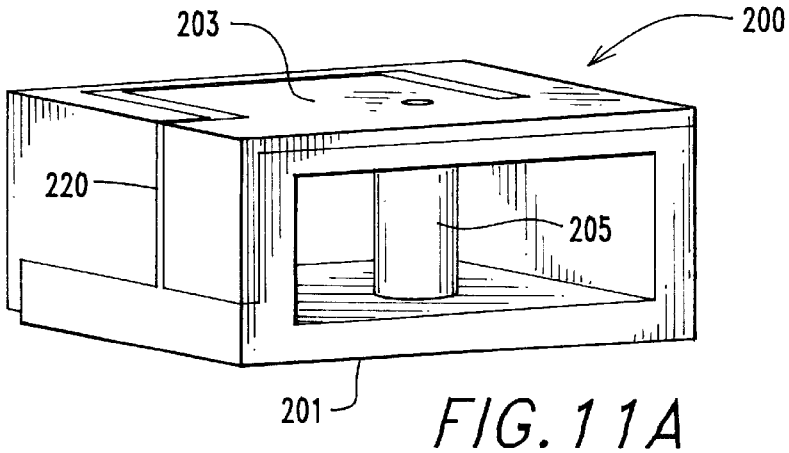
FIGS. 11A, 11B and 11C show another manner of making a two-shot molded plastic member of the type shown FIG. 9 wherein radiating element and the matching network are integrally formed by metallizing the second-shot plastic material that is incorporated in the two-shot molded plastic member.
Figure 11B:
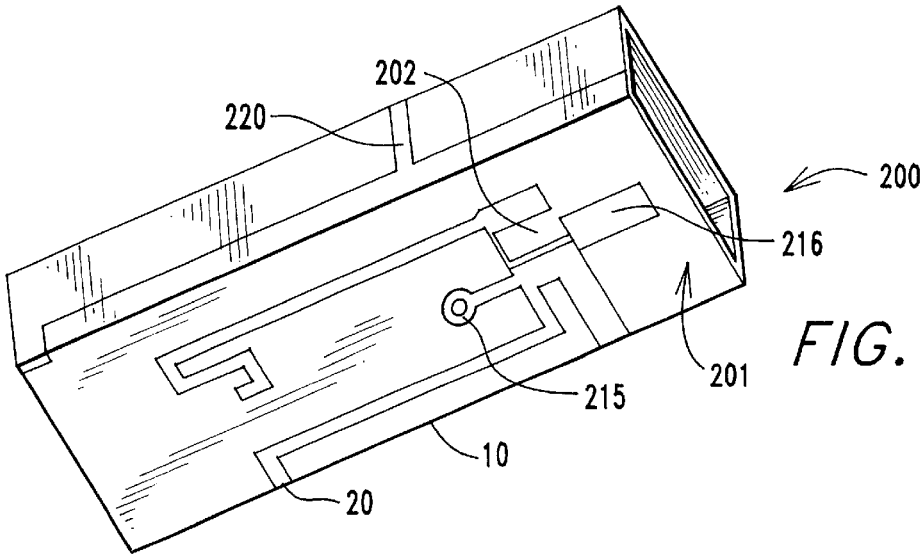
Figure 11C:
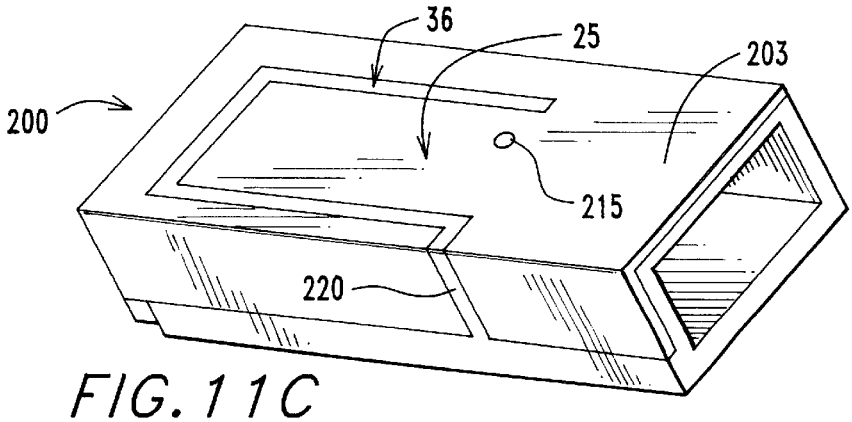

FIGS. 11A, 11B and 11C provide a showing of another example of a unitary plastic assembly 200 that includes both a radiating element 25 and an impedance matching network 10, wherein FIG. 11A is a generally side perspective view of plastic assembly 200, wherein FIG. 11B is a generally bottom perspective view of plastic assembly 200, and wherein FIG, 11C is a generally top perspective view of plastic assembly 200.

As seen in FIG. 11A, the two-shot molded assembly 200 is in the form of a relatively thin-wall rectangular-cylinder, i.e. an assembly 200 having a rectangular cross section and an open core in which a plastic post 205 is located. The purpose of post 205 is to provide a second-shot metallized electrical path between the matching network and the radiating element.

FIG. 11B better shows the bottom planar surface 201 of plastic assembly 200, this bottom surface 201 including the above-described impedance matching network 10 and one or more recessed cavities or pockets 202 for use in mounting the impedance matching network's discrete-component capacitor(s) and inductor(s), which LC components can be soldered in place, or can be snapped in place, within pocket(s) 202.

FIG. 11C better shows the top surface 203 of plastic assembly 200, this top surface 203 including a radiating element 25.

A metallized path 220 on the side of assembly 200 operates to connect radiating element 25 to a ground plane element (not shown). Electrical contact to a WCD feed 216 is provided by way of a spring biased pad (not shown) that is carried by a telephone's printed circuit board, as the bottom surface 201 of assembly 200 is physically mounted onto this printed circuit board. Electrical contact to an antenna feed 215 is provided by a metallized via or surface that extends between the bottom surface 201 of plastic assembly 200 to the top surface 203 of plastic assembly 200 (see FIGS. 11B and 11C).

It is also within the spirit and scope of this invention to form a unitary assembly that contains radiating/receiving element 25 and an impedance matching network 10 from a single sheet of an electrically conductive metal, the metal sheet being thick enough to be essentially self-supporting. In this embodiment of the invention, the metal sheet is first stamped or cut in a manner to form the metal patterns that form the radiating element and the impedance matching network.

The stamped metal sheet is then bent to form a three-dimensional metal structure wherein the radiating element and the impedance matching network are separated by an air dielectric space.

Alternatively, and in the event that the metal sheet is not self supporting, posts of dielectric material may be used to hold the radiating element and the impedance matching network physically spaced apart.

Discrete capacitor and inductor components are then soldered to the metal portions of the three-dimensional metal structure that form the microstrip transmission line and the microstrip stubs of the impedance matching network.

FIGS. 12A–12E show another embodiment of the invention that comprises a small, hollow, thin, box-like shaped, two-shot-molded plastic-antenna-assembly 300 wherein the surface of the assembly's second-shot plastic material is metallized to provide metal patterns that comprise a radiating element, a ground plane element, and an impedance matching network.

Figure 12A:
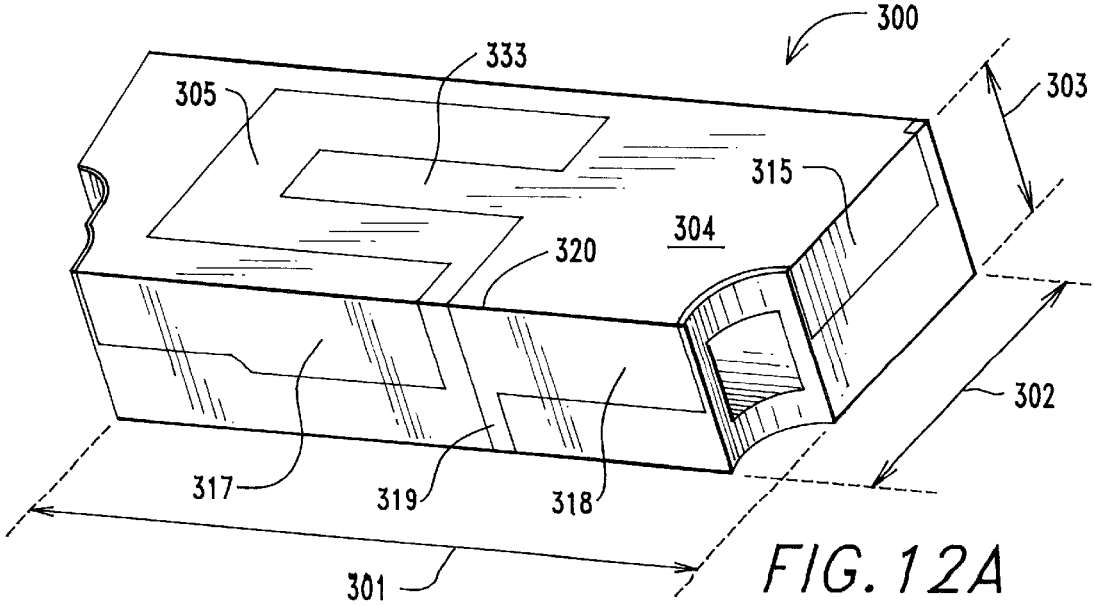
FIGS. 12A–12E show another embodiment of the invention that comprises a small, hollow, thin, box-like shaped, two-shot-molded plastic-antenna-assembly wherein the surface of the assembly's second-shot plastic material is metallized to provide metal patterns that form a radiating element, a ground plane element, and an impedance matching network, wherein the impedance matching network includes a microstrip impedance transformer, and wherein the impedance matching network does not include an LC trap.

With reference to FIG. 12A, in a non-limiting embodiment of the invention antenna-assembly 300 had a length dimension 301 of about 37.2 mm, a width dimension 302 of about 15 mm, and a thickness or height dimension 303 of about 7.4 mm.

FIG. 12A is a top perspective view of antenna-assembly 300 that shows the antenna's planar second-shot metal radiating element 304 that includes a generally U-shaped slot 305 that contains first-shot plastic material. Assembly 300 is constructed and arranged to provide three-band performance, for example in the three frequency bands 880–960 KHz, 1710–1880 KHz and 1885–2220 KHz.

Figure 12B:
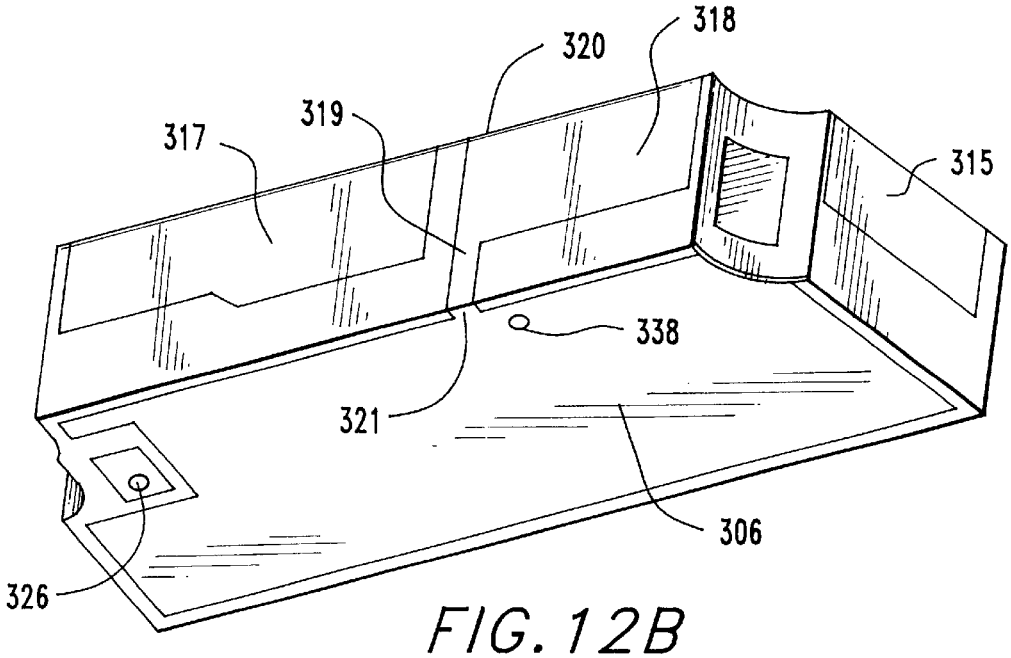

FIG. 12B is a bottom perspective view of antenna-assembly 300 that shows the antenna's planar second-shot metal ground plane element 306 that lies in a plane that is generally parallel to FIG. 12A's top-located radiating element 304.

Figure 12C:
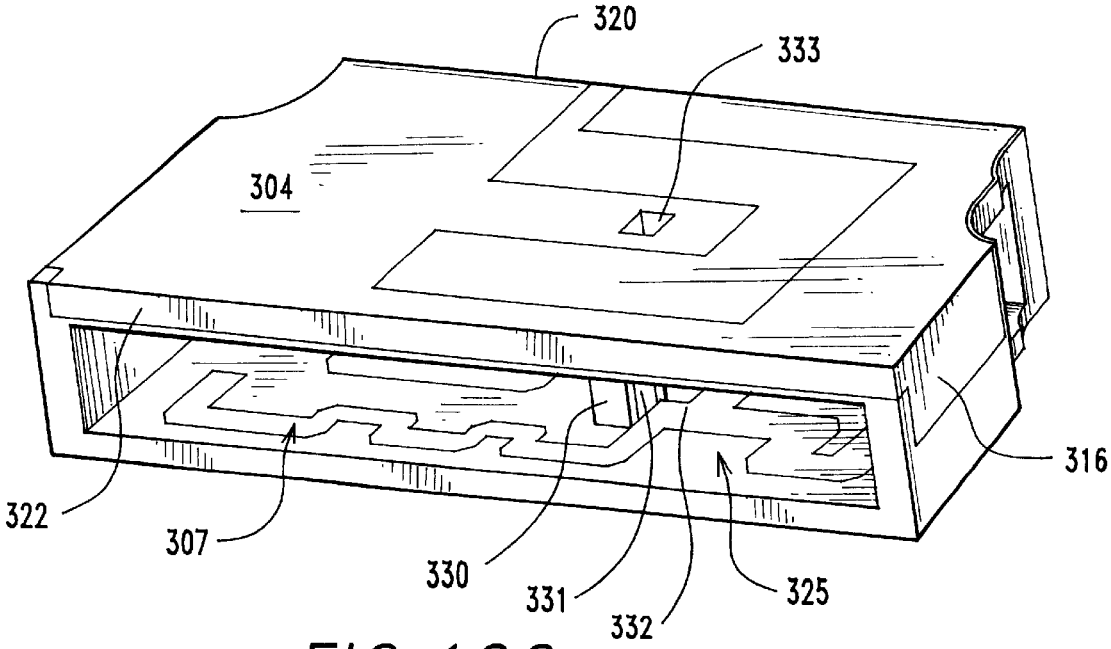

FIG. 12C is perspective view of antenna-assembly 300 that shows the antenna's hollow interior and the antenna's impedance matching network 307.

Figure 12D:
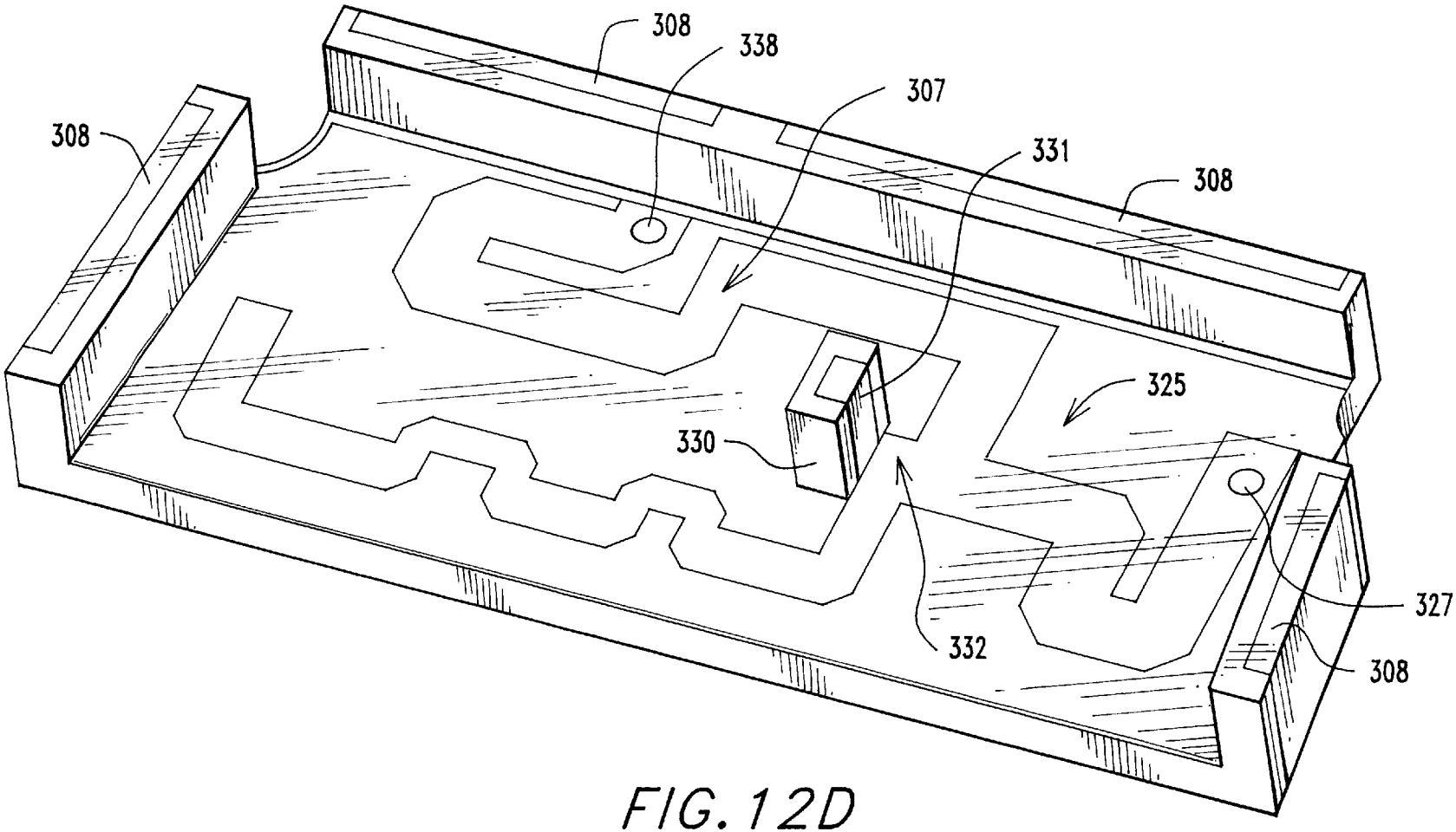

FIG. 12D is a perspective view of antenna-assembly 300 that is similar to FIG. 12C. In FIG. 12D the top-wall of antenna-assembly 300 (i.e. the wall that holds radiating element 304) has been removed to more clearly show the antenna's second-shot metal impedance matching network 307 that is located on the interior surface of the assembly's bottom-wall (i.e. the wall that holds FIG. 12B's ground plane element 306).

FIG. 12D also shows an example of the thickness of the second-shot plastic material 308 whose external surface is metallized. FIG. 12D also shows a microstrip circuit pattern that forms impedance matching network 307.

The plastic, second-shot, and metallized portions of antenna-assembly 300 include (1) radiating element 304 on the top exterior surface thereof (FIGS. 12A and 12C), (2) ground plane element 306 on the bottom exterior surface thereof (FIG. 12B), (3) an antenna loading plate 315 on the exterior surface of a first sidewall thereof (FIGS. 12A and 12B), (4) an antenna loading plate 316 on the exterior surface of a second exterior sidewall thereof (FIG. 12C), (5) an antenna loading plate 317 on the exterior surface of a third sidewall thereof (FIGS. 12A and 12B), (6) an antenna loading plate 318 on the exterior surface of the third sidewall (FIGS. 12A and 12B), (7) a shorting stub 319 on the exterior surface of the third sidewall, wherein shorting stub 319 operates to directly connect or short a portion 320 of radiating element 304 to a portion 321 of ground plane element 306 (FIGS. 12 and 12B), and (8) a relatively short antenna loading plate 322 on the portion of antenna-assembly 300 that defines an opening on the fourth sidewall of antenna-assembly 300 (FIG. 12C).

While not critical to the invention, in this embodiment of the invention the four sidewalls of antenna-assembly 300 were generally flat sidewalls that extended generally perpendicular to the plane of radiating element 304 and to the plane of ground plane element 306.

As best seen in FIGS. 12C and 12D, the fourth sidewall of antenna assembly 300 is open, and this opening exposes the hollow and box-like interior of antenna-assembly 300.

When antenna-assembly 300 is viewed as shown in FIGS. 12C and 12D, it can be seen that the inner bottom surface 325 of antenna-assembly 300 contains a second-shot metal microstrip pattern that forms the antenna's impedance matching network 307.

When antenna-assembly 300 is viewed as shown in FIG. 12B, it is seen that the bottom exterior surface that contains ground plane element 306 also includes a relatively small second-shot metal pad 326 that electrically connects to a portion 327 of impedance matching network 307 (portion 327 is seen in both FIG. 12D and FIG. 12E), thus forming a radio-feed point 326 for connecting antenna-assembly 300 to a radio-device such as a cellular telephone (see 27 of FIG. 1).

When antenna-assembly 300 is viewed as shown in FIG. 12D, it is seen that the inner bottom surface 325 of antenna-assembly 300 includes a plastic post 330 that extends upward and generally perpendicular from surface 325. Post 330 includes a second-shot metal portion 331 that electrically connects a portion 332 of impedance matching network 307 (also seen in FIG. 12E) to a portion 333 of radiating element 304 (portion 333 of radiating element 304 is best seen in FIGS. 12A and 12C), thus forming an antenna-feed point 333 for antenna-assembly 300.

Figure 12E:
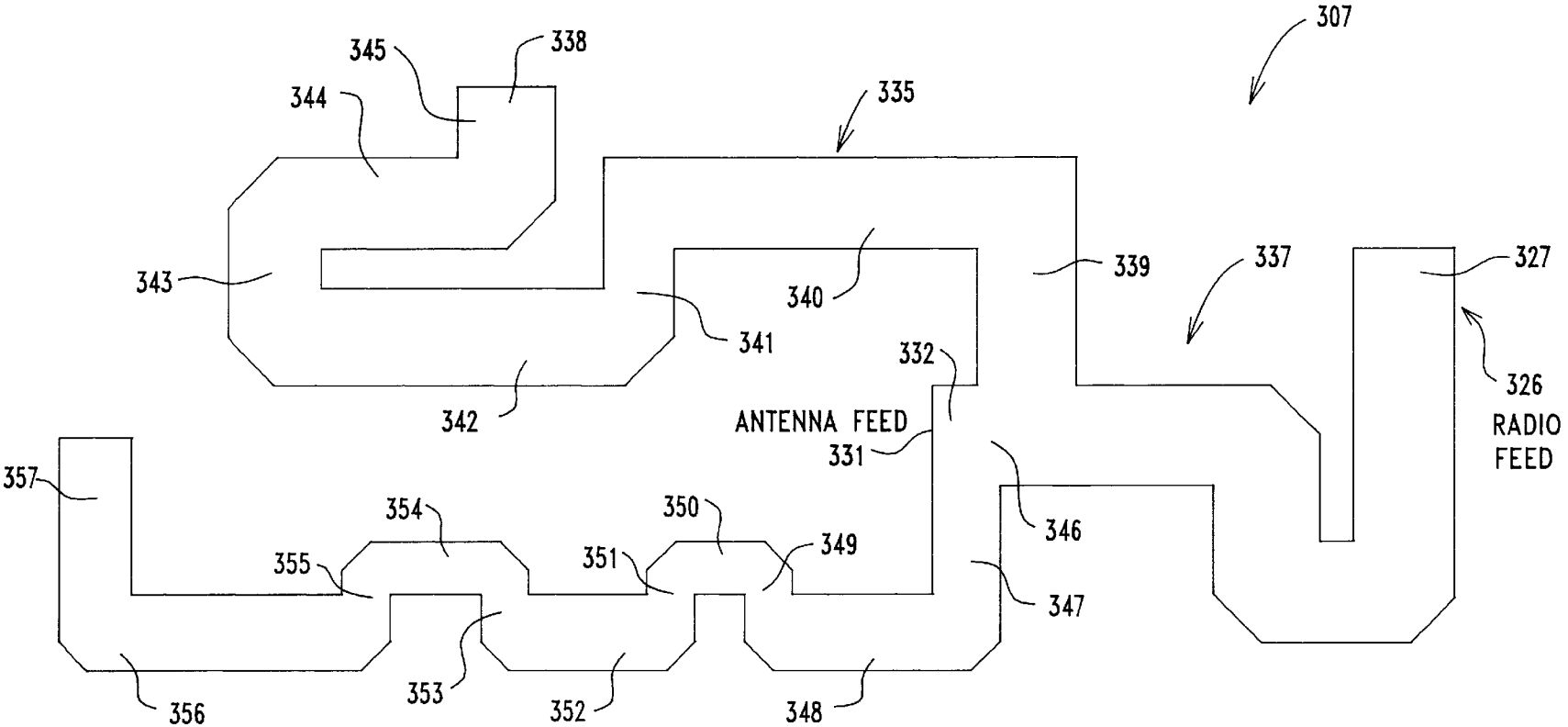

FIG. 12E is a plan view showing the microstrip circuit pattern that forms impedance matching network 307. This impedance matching network includes (1) a shorted transmission line stub 335, (2) an open transmission line stub 336, and a microstrip impedance transformer 337.

The end 338 of shorted microstrip stub 335 is directly connected to ground plane element 306 (also see FIGS. 12B and 12D), and shorted stub 335 is made up of the seven series-connected microstrip circuit segments 339–345.

Open microstrip stub 336 is made up of the twelve series-connected microstrip circuit segments 346–357, no segment of which is connected to ground plane element 306.

The portion of impedance matching network 307 that includes shorted microstrip stub 335 and open microstrip stub 336 is constructed and arranged to facilitate the above-described three-band performance for antenna assembly 300. Note that this is done without the use of frequency-responsive disconnecting LC tank circuits, as above-described.

However, as such, impedance matching network 307 does not (in the absence of microstrip impedance transformer 337) present the required impedance to the input of a radio-device, such as a cellular telephone, that is connected to the antenna assembly's radio-feed 326. An example of such a required radio-feed impedance is about 50 ohms.

In order to provide this required impedance match between radio-feed 327 and the portion of impedance matching network 307 that includes shorted microstrip stub 335 and open microstrip stub 336, microstrip impedance transformer 337 is provided.

Microstrip impedance transformer 337 operates to transform the impedance of this portion of impedance matching network 307 an impedance of about 50 ohms, thus providing a desired impedance match to a radio-device that is connected to the antenna assembly's radio-feed 327.

In this embodiment of the invention the wall-thickness of the two-shot plastic assembly was about 1.25 mm and the plastic material that formed this assembly had a dielectric constant in the range of from about 3 to about 4. This dielectric constant can be less than this 3-to-4 range, however the physical size of the assembly will likely increase.

When the interior-located impedance matching network shown in FIGS. 12C and 12D is compared to the exterior-located impedance matching network shown in FIG. 11B, it is noted that the antenna assembly of FIG. 11B cannot be placed on an electrically conductive surface since such a conductive surface would short this exterior-located impedance matching network.

While this invention has been described in detail while making reference to various embodiments thereof, it is recognized that others skill in the art will, upon learning of this invention, readily visualize yet other embodiments that are within the spirit and scope of this invention. Thus this detailed description is not to be taken as a limitation on the spirit and scope of this invention.

What is claimed is:

1. An antenna responsive to a plurality of frequency bands, comprising:

a radiating element geometrically configured to be responsive to said plurality of frequency bands;

a ground plane element positioned away from said radiating element to thereby define a space between said ground plane element and said radiating element;

an antenna-feed connected to said radiating element;

a device-feed for connection to a radio device;

a transmission line connected between said antenna-feed and said device-feed;

a plurality of transmission line stubs associated with said transmission line;

at least one frequency responsive high impedance circuit responsive to at least one frequency within said plurality of frequency bands; and at least one transmission line stub connected to said transmission line by way of said at least one frequency responsive high impedance circuit such that said radiating element is matched to said radio feed within each of said plurality of frequency bands, as said at least one frequency responsive high impedance circuit operates to dynamically reconfigured said transmission line in accordance with a frequency band currently traversing said transmission line.

2. The antenna of claim 1 wherein said transmission line, said at least one transmission line stub and said at least one frequency responsive high impedance circuit comprise an impedance matching network that is physically located within said space between said ground plane element and said radiating element.

3. The antenna of claim 1 wherein said at least one frequency responsive high impedance circuit comprises at least one LC tank circuit having a discrete capacitor element and a discrete inductor element.

4. The antenna of claim 3 wherein said transmission line, said at least one transmission line stub and said at least one LC tank circuit comprise an impedance matching network that is physically located in said space between said ground plane element and said radiating element.

5. The antenna of claim 1 wherein the radio device is a wireless communications device, wherein said antenna is a planar inverted-F antenna having a metal planar radiating element and a metal planar ground plane element that is shorted to said radiating element.

6. The antenna of claim 5 wherein a two-shot molding process is used to make a plastic assembly whose outer surface is selectively metallized to provide said radiating element on one surface of said plastic assembly, and to provide metal patterns on an opposite surface of said plastic assembly that define said transmission line and said at least one transmission line stub.

7. The antenna of claim 6 wherein said metal patterns cooperated with said ground plane element to form a microstrip transmission line and at least one microstrip stub.

8. The antenna of claim 7 wherein said microstrip transmission line, said at least one microstrip stub and said at least one frequency responsive high impedance circuit comprise an impedance matching network that is physically located in said space between said ground plane element and said radiating element.

9. The antenna of claim 8 wherein said at least one frequency responsive high impedance circuit comprises at least one LC tank circuit having a discrete capacitor element and a discrete inductor element.

10. The antenna of claim 9 wherein the radio device is a wireless communications device.

11. The antenna of claim 10 wherein a two-shot molding process is used to make a plastic assembly whose outer surface is selectively metallized to provide said radiating element on one surface of said plastic assembly, and to provide metal patterns on an opposite surface of said plastic assembly that define said microstrip transmission line and said at least one microstrip stub.

12. A method of making a unitary mechanical assembly that includes a multi-band antenna and an impedance matching network, comprising the steps of:

providing a dielectric substrate having a top surface and a bottom surface;

providing a metal ground plane element on said bottom surface of said dielectric substrate;

providing a metal radiating element;

configuring said radiating element to be responsive a plurality of frequency bands;

spacing said radiating element from said top surface of said ground plane element;

providing a radio feed for connection to a multi-band radio device;

providing at least one metal microstrip transmission line on said top surface of said dielectric substrate and in an area thereof that is under said radiating element;

connecting said at least one microstrip transmission line between said radiating element and said radio feed;

providing a plurality of metal microstrip stubs on said top surface of said dielectric substrate and in said area under said radiating element;

providing a plurality of frequency-responsive LC tank circuits;

using said LC tank circuits to connect at least some of said microstrip stubs to said at least one microstrip transmission line, to thereby provide an impedance-matching-network that is responsive to a frequency currently traversing between said radiating element and said radio feed, to thereby dynamically reconfigure said impedance-matching-network to provide an impedance match between said radiating element and said radio feed as a function of said current-frequency.

13. The method of claim 12 wherein said plurality of frequency-responsive LC tank circuits include discrete capacitor and inductor elements that are located in a space under said radiating element.

14. The method of claim 13 including the steps of:

providing a box-like dielectric member in said space under said radiating element; and forming said dielectric member using a two shot molding process having top portions metallized to form said radiating element and having bottom portions metallized to form said at least one microstrip transmission line and said plurality of microstrip stubs.

15. The method of claim 14 wherein said bottom portions of said dielectric member include recesses for holding said discrete capacitor and inductor elements.

16. The method of claim 15 including the step of:

electrically connecting a portion of said radiating element to said ground plane element so as to form a PIFA.

17. An impedance-matched, multi-frequency-band, antenna having a device-feed for connection to a multi-frequency-band wireless communications device, comprising:

a generally planar and dielectric substrate member having an upper surface and a lower surface that includes a generally planar and metal ground plane element;

a generally planar and metal radiating element located above a portion of said upper surface of said dielectric substrate member, said radiating element being geometrically configured to be responsive to said multi-frequency-band;

a metal microstrip transmission line on said portion of said upper surface of said dielectric substrate member, said microstrip transmission line connecting said radiating element to said device-feed;

a plurality of LC tank circuits responsive to frequencies within said multi-frequency-band; and a plurality of metal microstrip stubs formed on said portion of said upper surface of said dielectric substrate, at least some of said microstrip stubs being directly connected to said microstrip transmission line, and at least others of said microstrip stubs being connected to said microstrip transmission line through at least one of said LC tank circuits.

18. The antenna of claim 17 wherein said plurality of LC tank circuits are located in a space between said radiating element and said portion of said upper surface of said dielectric substrate member.

19. The antenna of claim 18 wherein said radiating element is generally parallel to said ground plane element, and wherein a portion of said radiating element is electrically connected to said ground plane element.

20. The antenna of claim 19 wherein said multi-frequency-band wireless communications device is a cellular telephone.

21. An impedance-matched and multi-frequency-band antenna having a device-feed for connection to a multi-frequency-band wireless device, comprising:

a box-like dielectric carriage having a generally planar upper surface and a generally planar lower surface that extends generally parallel to said upper surface;

a generally planar and metal ground plane element having at least a portion thereof associated with said bottom surface of said dielectric carriage;

a generally planar and metal radiating element formed on said upper surface of said dielectric carriage, said radiating element being geometrically configured to be responsive to said multi-frequency-band;

a metal microstrip transmission line formed on said bottom surface of said dielectric carriage, said microstrip transmission line inter-connecting said radiating element and said device-feed;

a plurality of metal microstrip stubs formed on said bottom surface of said dielectric carriage;

a plurality of LC tank circuits responsive to frequencies within said multi-frequency-band; and at least some of said microstrip stubs directly connected to said microstrip transmission line, and at least others of said microstrip stubs indirectly connected to said microstrip transmission line through one or more of said LC tank circuits.

22. The antenna of claim 21 wherein said dielectric carriage is formed by a two-shot molding process, followed by a metallization process that produces said metal radiating element, said microstrip transmission line, and said plurality of microstrip stubs on said dielectric carriage.

23. The antenna of claim 22 wherein a portion of said radiating element is electrically connected to said ground plane element.

24. The antenna of claim 23 wherein said multi-frequency-band wireless device is a cellular telephone.

25. An impedance-matched and multi-frequency-band antenna having a device-feed for connection to a multi-frequency-band wireless device, comprising:

a box-like dielectric carriage having a generally planar upper surface and a generally planar bottom surface that extends generally parallel to said upper surface;

a metal radiating element formed on said upper surface of said dielectric carriage, said radiating element being geometrically configured to be responsive to said multi-frequency-band;

a generally planar and metal ground plane element;

an generally planar impedance matching board located intermediate said bottom surface of said dielectric carriage and said ground plane element;

a metal microstrip transmission line formed on said impedance matching board and electrically interconnecting said device-feed and said radiating element;

a plurality of metal microstrip stubs formed on said impedance matching board;

a plurality of LC tank circuits responsive to frequencies within said multi-frequency-band; and at least some of said microstrip stubs directly connected to said microstrip transmission line, and at least others of said microstrip stubs indirectly connected to said microstrip transmission line through one or more of said LC tank circuits.

26. The antenna of claim 25 wherein said dielectric carriage and said impedance matching board are formed by two-shot molding processes, followed by metallization processes that produces said metal radiating element on said dielectric carriage, and produces said microstrip transmission line and said plurality of microstrip stubs on said impedance matching board.

27. The antenna of claim 26 wherein a portion of said radiating element is electrically connected to said ground plane element.

28. The antenna of claim 27 wherein said multi-frequency-band wireless device is a cellular telephone.

29. An antenna for use with a radio-device, comprising:

a rigid dielectric member in the shape of a box having a generally planar exterior top-surface, having a generally planar exterior bottom-surface that is generally parallel to said top-surface, having sidewalls that extend between said top and bottom surfaces, and having an open sidewall that exposes an internal cavity and an inner-surface that lies adjacent and generally parallel to said bottom surface;

a metal radiating element on said top-surface;

a metal ground plane on said bottom-surface;

a metal microstrip impedance matching network on said internal-surface;

first electrical connection means on a first portion of said impedance matching network for connection to said radio-device; and second electrical connection means connecting a second portion of said impedance matching network to a first portion of said radiating element.

30. The antenna of claim 29 wherein said dielectric member is formed by a two-shot molding process that produces said dielectric member including a first-shot plastic material having no affinity for metallizing, and a second-second shot plastic material having an affinity for metallization;

said a metal radiating element, said metal ground plane and said metal impedance matching network being formed by metallizing said second-shot plastic.

31. The antenna of claim 29 including:

at least one open microstrip stub in said impedance matching network; and at least one shorted microstrip stub in said impedance matching network pattern having a portion thereof shorted to said ground plane.

32. The antenna of claim 31 wherein said dielectric member is formed of a first-shot plastic material having no affinity for metallizing and of a second-second shot plastic material having an affinity for metallization, and wherein said a metal radiating element, said metal ground plane, and said metal impedance matching network are formed by metallizing said second-shot plastic.

33. The antenna of claim 29 including:

at least one metal reactive loading plate on one of said sidewalls connected to said radiating element and isolated from said ground plane.

34. The antenna of claim 33 including:

at least one open microstrip stub in said impedance matching network; and at least one shorted microstrip stub in said impedance matching network pattern having a portion thereof shorted to said ground plane.

35. The antenna of claim 29 including:

a metal shorting strip on one of said sidewalls connecting a second portion of said radiating element.

36. The antenna of claim 35 including:

at least one metal reactive loading plate on one of said sidewalls connected to said radiating element and isolated from said ground plane.

37. The antenna of claim 36 including:

at least one open microstrip stub in said impedance matching network; and at least one shorted microstrip stub in said impedance matching network pattern having a portion thereof shorted to said ground plane.

* * * * *